US006135439A

United States Patent [19]

Ikeda

[11] Patent Number: 6,135,439

[45] Date of Patent: Oct. 24, 2000

[54] SHEET FEEDING APPARATUS

[75] Inventor: Yasuhiko Ikeda, Sagamihara, Japan

[73] Assignee: Canon Kabushiki Kaisha, Tokyo, Japan

[21] Appl. No.: 09/339,937

[22] Filed: Jun. 25, 1999

[30] Foreign Application Priority Data

Jun. 29, 1998 [JP] Japan ..... 10-182948

[51] Int. Cl.[7] ..... B65H 5/00

[52] U.S. Cl. ..... 271/10.03; 271/110

[58] Field of Search ..... 271/10.03, 10.09, 271/10.16, 110, 114, 118, 119, 121, 258.01, 265.01, 270

[56] References Cited

U.S. PATENT DOCUMENTS 3,981,497 9/1976 Feinstein, Jr. et al. ..... 271/110 X 5,465,949 11/1995 Yamada et al. ..... 271/110

5,924,686 7/1999 Jacobson et al. ..... 271/10.03 X 5,971,388 10/1999 Hattori et al. ..... 271/10.03

5,996,993 12/1999 Arikawa et al. ..... 271/10.03 X

*Primary Examiner*—David H. Bollinger

*Attorney, Agent, or Firm*—Fitzpatrick, Cella, Harper & Scinto

[57] ABSTRACT

The present invention relates to a sheet feeding apparatus comprising a sheet supporting mechanism, a sheet feeding mechanism, a driving mechanism, a sheet detecting device, and a drive control device for controlling the driving mechanism in such a manner that, even when the driving mechanism is operated at a predetermined speed for a predetermined time period, if the sheet is not detected by the sheet detecting device, the driving mechanism is operated at a speed slower than the predetermined speed.

11 Claims, 10 Drawing Sheets

SHEET FEEDING APPARATUS

BACKGROUND OF THE INVENTION

1. Field of the Invention

The present invention relates to a sheet feeding apparatus for feeding sheets one by one and particularly with reducing double-feeding, and an image forming apparatus such as a copying machine, a printer, a facsimile and the like, having such a sheet feeding apparatus.

2. Related Background Art

In conventional sheet feeding apparatuses, a time period from when feeding of a sheet is started to when the sheet is detected by a detection means (for example, sheet feed sensor) for detecting the feeding of the sheet was constant. After start of the feeding of the sheet, if the sheet is not detected by the sheet feed sensor even after a predetermined time period is elapsed, it is assumed that sheet jam occurs, and the sheet jam is informed of an operator by an alarming means.

Cause of the sheet jam includes wear and/or looseness of a sheet feed roller or a sheet feed belt in a sheet feeding mechanism, paper powder adhered to the sheet and sheet slip due to feeding by low coefficient of friction.

Even when the sheet feeding abnormal condition is informed of the operator by the alarming means, the operator may perform the sheet feed control (retry) again to continue the operation of the sheet feeding apparatus.

Also in such a case, the sheet feeding apparatus repeats the same operation again. By repeating the same operation, for any reason, the abnormal condition may be disappeared to permit the feeding of the sheet.

However, if the sheet feeding apparatus repeats the same operation, the poor sheet feeding may often occur due to the same reason. In this case, the operator do not know how to cope with the poor sheet feeding. As a result, entire sheet feeding efficiency of the sheet feeding apparatus is worsened.

Further, in an image forming apparatus having such a sheet feeding apparatus, since the sheet is not fed from the sheet feeding apparatus smoothly, an image forming efficiency is worsened.

SUMMARY OF THE INVENTION

A first object of the present invention is to provide a sheet feeding apparatus in which, when sheet feed control is effected again, poor sheet feeding due to slip and looseness of a sheet feed roller can be prevented, and reliability of sheet feeding regarding a bad quality sheet can be enhanced, and a rate of poor sheet feeding during retry can be reduced.

A second object of the present invention is to provide a sheet feeding apparatus in which, when the sheet feeding apparatus provided by the first object is carried out, the sheet feed control can be effected again positively and cheaply, and control can be effected with a simple construction and without changing parameters other than a feeding speed and a feeding time between the first sheet feeding and sheet re-feeding.

A third object of the present invention is to provide a sheet feeding apparatus in which, even if excessive load acts on a sheet feed roller, when second retry and so are effected, control can be effected so that poor sheet feeding is hard to occur.

A fourth object of the present invention is to provide a sheet feeding apparatus in which control for judging sheet re-feeding can be effected cheaply and positively, and control can be effected with a simple construction and without changing parameters other than a feeding speed and a feeding time between the first sheet feeding and sheet re-feeding.

In the present invention, there are provided a sheet supporting means for supporting a sheet, a sheet feeding means for feeding the sheet supported by the sheet supporting means, a driving means for driving the sheet feeding means, a sheet detecting means for detecting the sheet fed by the sheet feeding means, and a drive control means for effecting the driving means in such a manner that, even when the driving means is operated at a predetermined speed for a predetermined time period, if the sheet is not detected by the sheet detecting means, the driving means is operated at a speed slower than the predetermined speed.

DESCRIPTION OF THE PREFERRED EMBODIMENTS

The present invention will now be explained with reference to the accompanying drawings.

Figure 1:
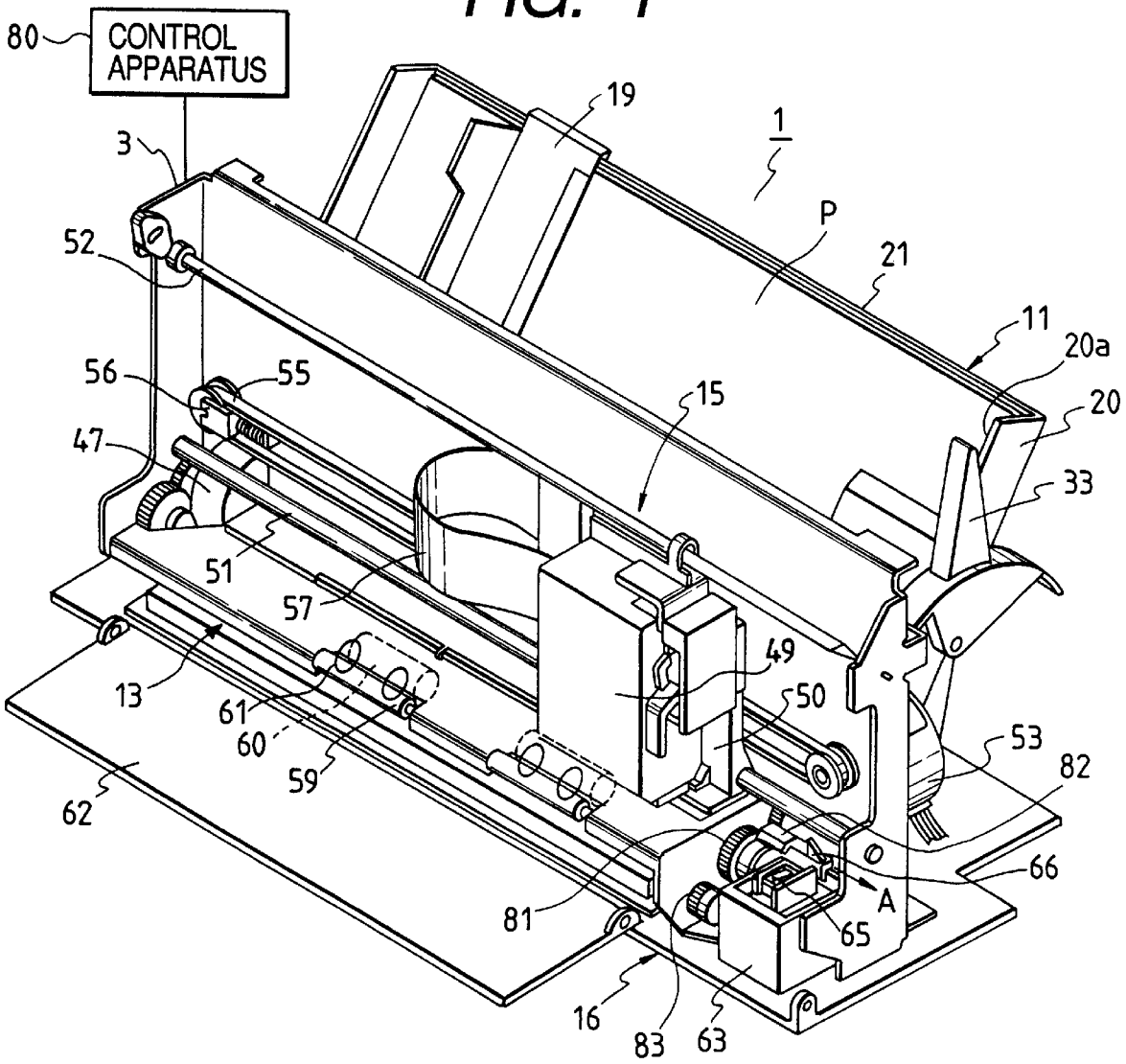
FIG. 1 is a perspective view of an image forming apparatus to which a sheet feeding apparatus according to an embodiment of the present invention is applied.

FIG. 1 is a perspective view of an image forming apparatus 1 to which a sheet feeding apparatus 11 according to an embodiment of the present invention is applied.

In FIG. 1, the sheet feeding apparatus 11 is attached to a main body 3 at an angle of about 30 to 60 degrees with respect to an installation plane of the image forming apparatus 1. A recording sheet P which is set in the sheet feeding apparatus 11 and on which an image is to be formed is discharged horizontally after printing.

As shown in FIGS. 1 to 6, the sheet feeding apparatus 11 comprises a sheet feeding roller (sheet feeding means) 5, a separation claw 17, a movable side guide 19, a base 20, a pressure plate 21, a pressure plate spring 22, drive gears 25 to 30, a release cam 31, a claw spring 32, a releasing lever 33 and a releasing cam 35.

Figure 7:
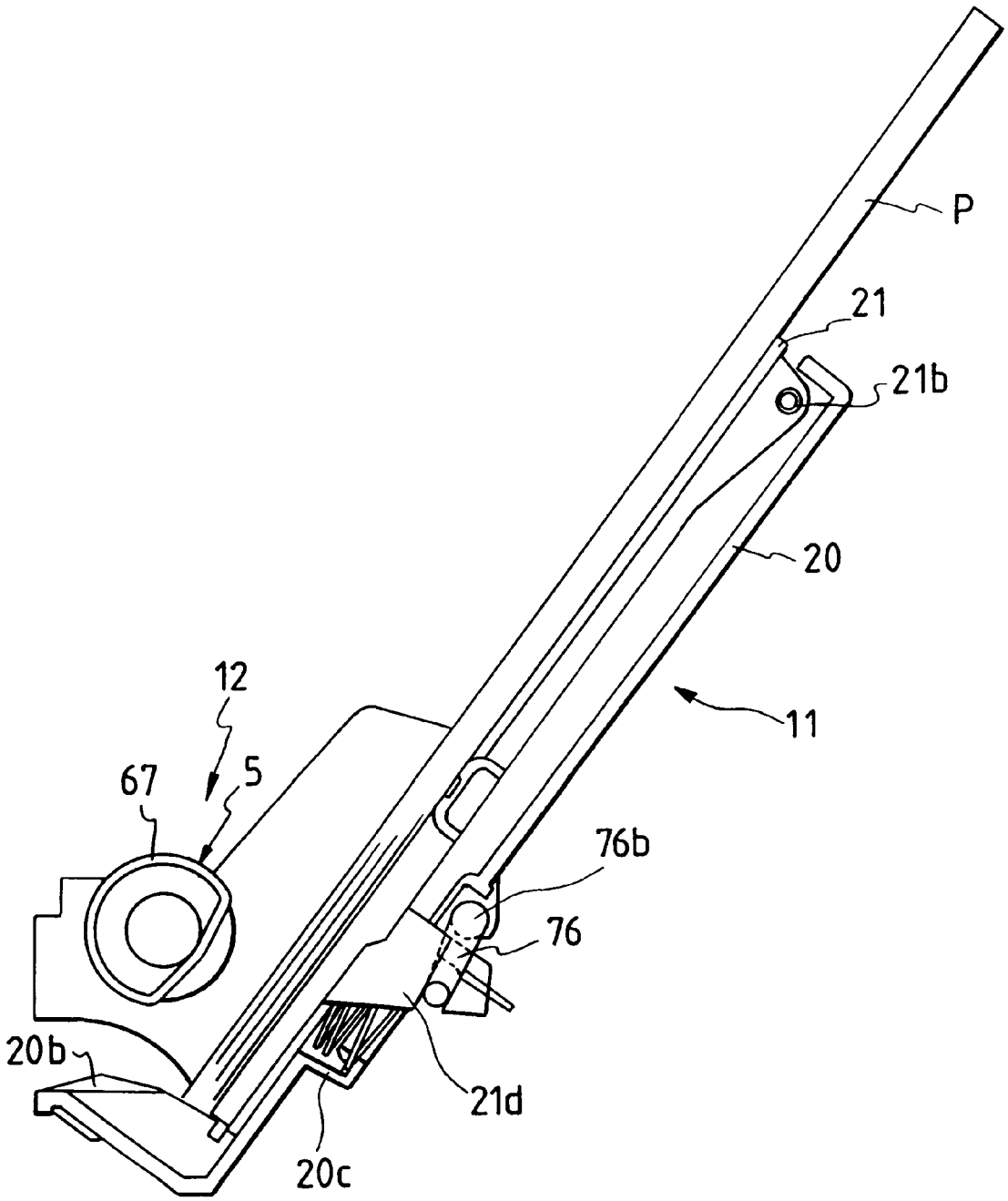
FIG. 7 is a side view of the sheet feeding portion.

Normally, the pressure plate 21 is lowered by the release cam 31 at a position shown in FIG. 7. Thus, the recording sheet P is spaced apart from the sheet feeding roller 5.

Figure 6:
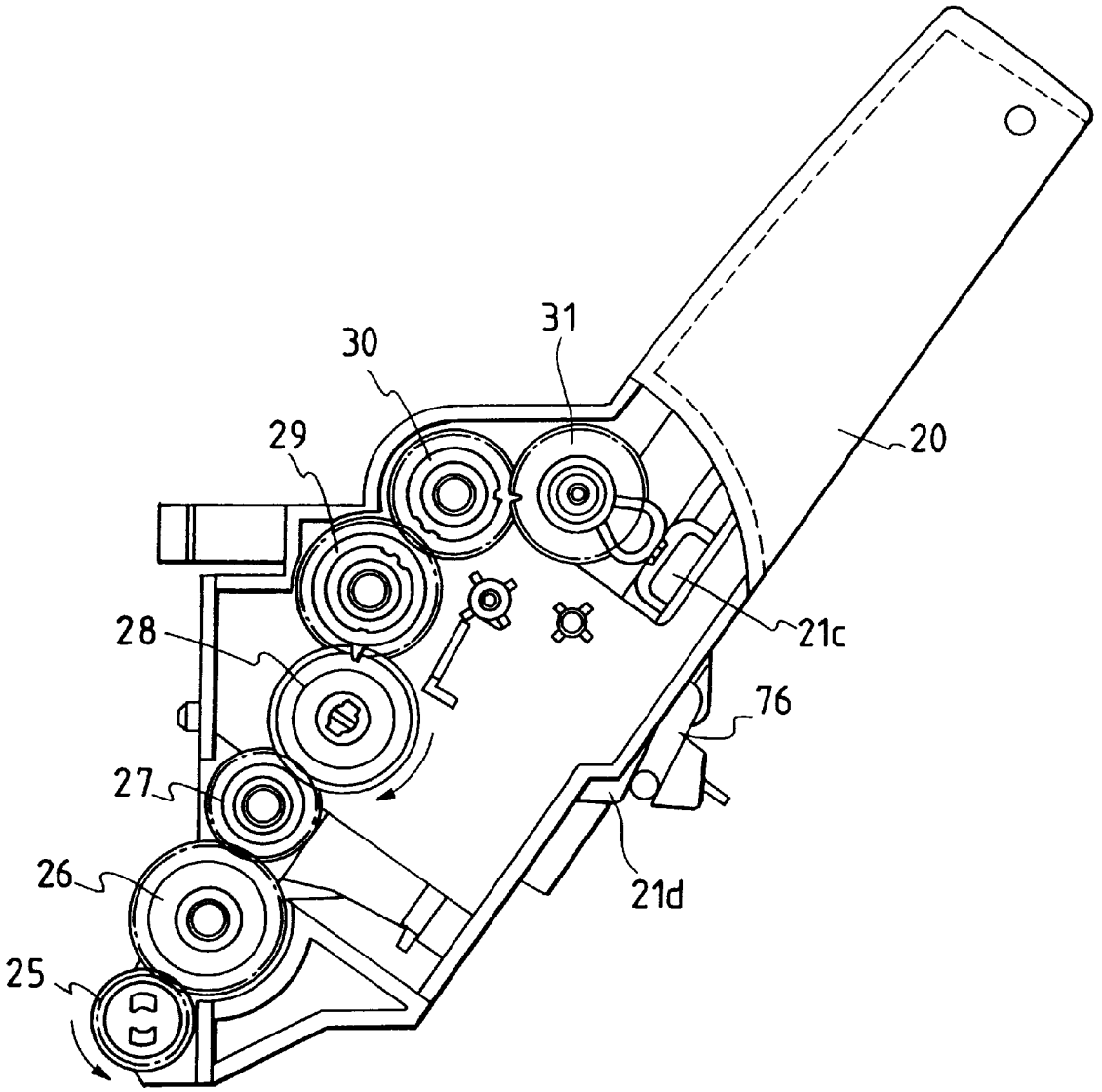
FIG. 6 is a side view of FIG. 4.
Figure 8:
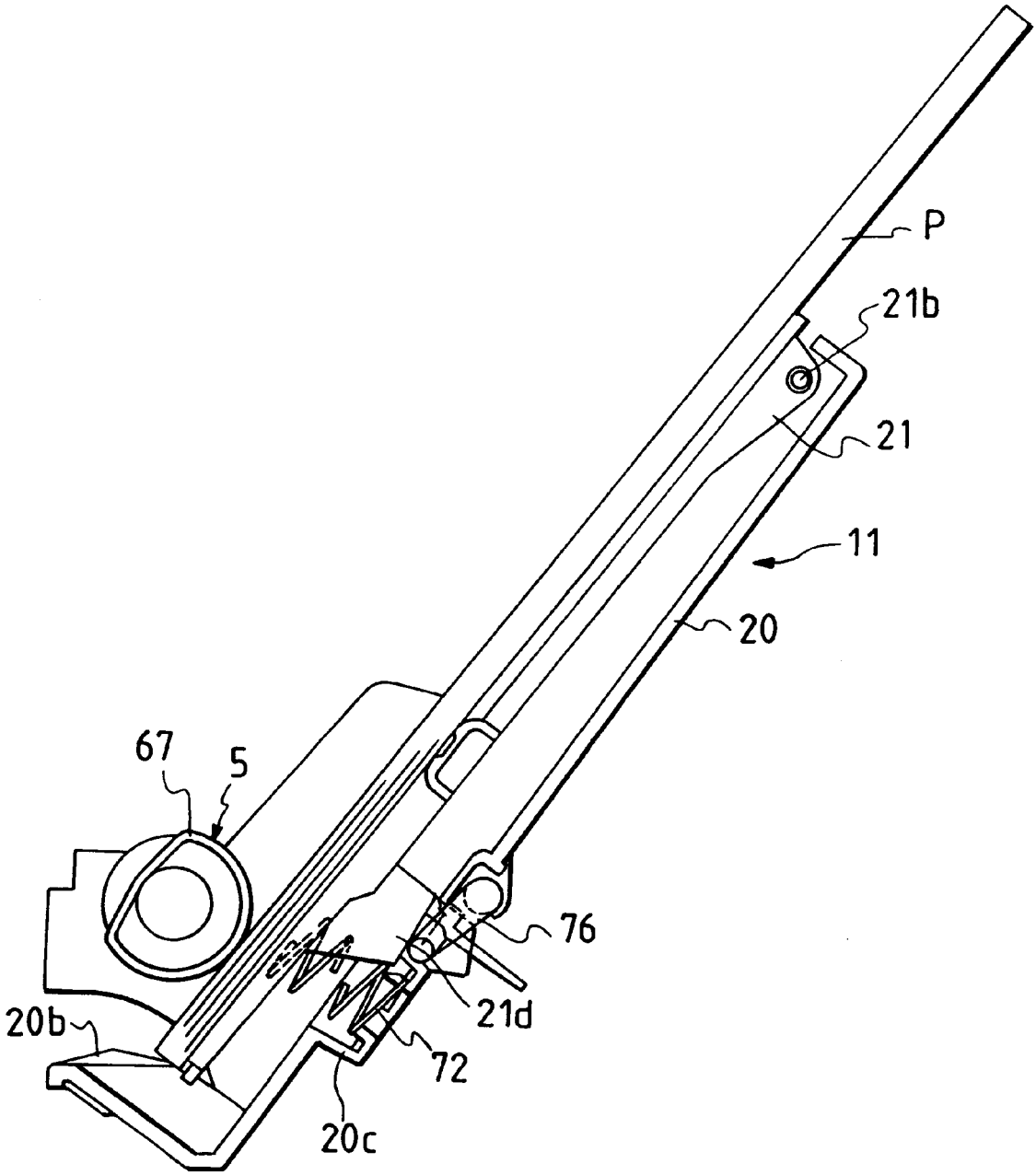
FIG. 8 is a side view of the sheet feeding portion.
Figure 9A:
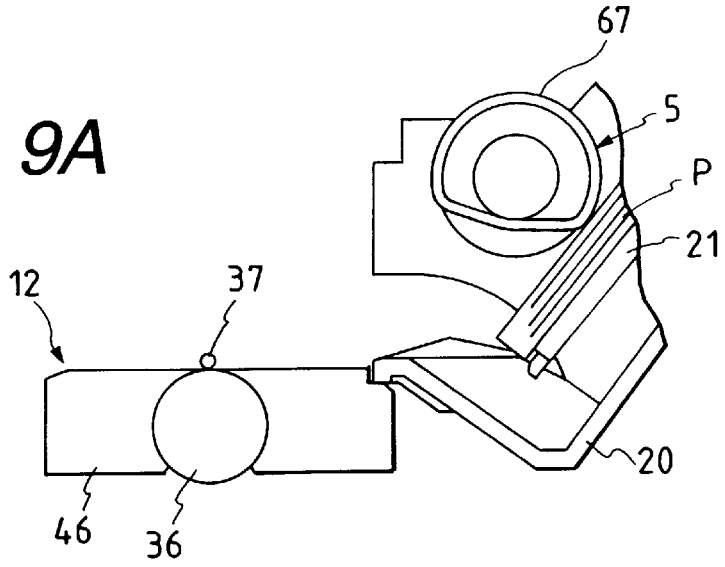
FIGS. 9A, 9B and 9C are views for explaining the sheet feeding roller and a convey roller.
Figure 9B:
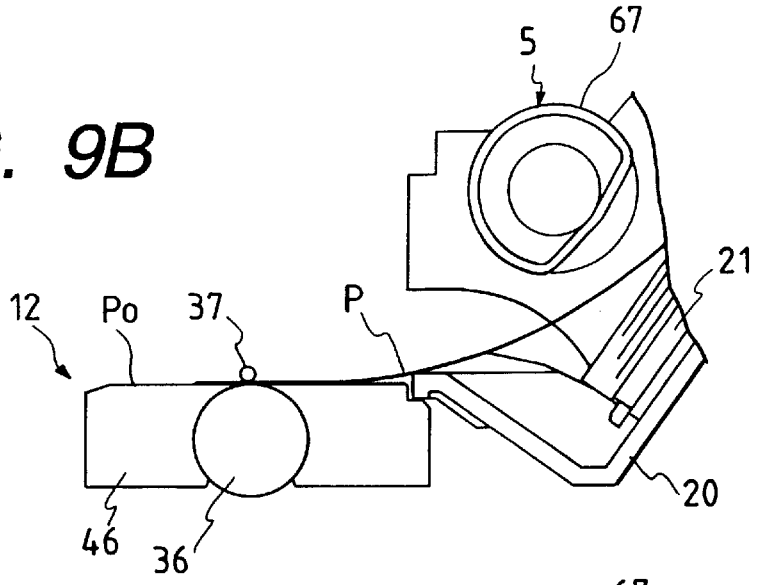
Figure 9C:
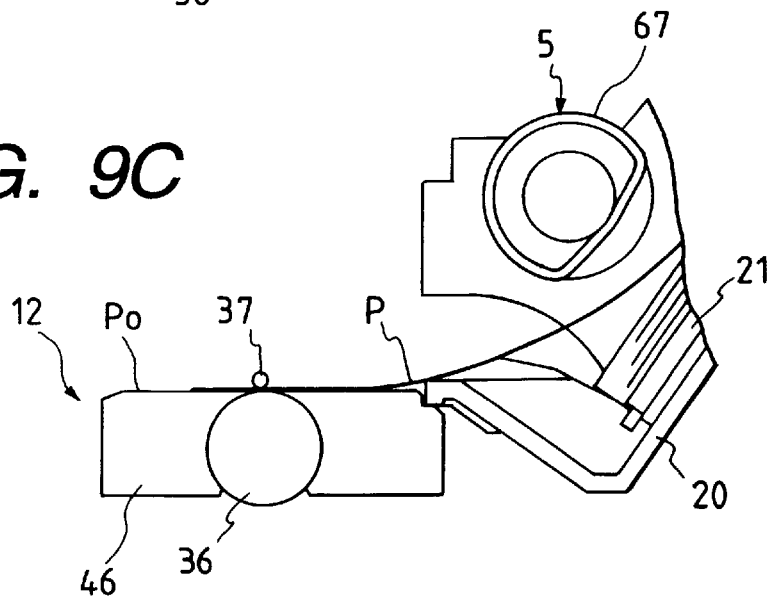

In a condition that the recording sheets P are set in the sheet feeding portion 11, a driving force of a convey roller shown in FIGS. 9A to 9C is transmitted to the sheet feeding roller 5 and the release cam 31 through the gears 25 to 30 shown in FIG. 6. When the release cam 31 is separated from the pressure plate 21, the pressure plate 21 is lifted up to a position shown in FIG. 8, with the result that the recording sheet P contacts the sheet feeding roller 5. The recording sheets P are picked up by rotation of the sheet feeding roller 5 and are separated one by one by the separation claw 17. The separated recording sheet P is sent to a sheet convey portion 12 shown in FIGS. 1 and 7. The sheet feeding roller 5 and the release cam 31 are rotated until the recording sheet P is sent to the sheet convey portion 12, and the condition that the pressure plate 21 is spaced apart from the sheet feeding roller 5 is restored again. In this case, the sheet feeding roller 5 and the release cam 31 do not receive the driving force from the convey roller 36, thereby maintaining their initial conditions.

Figure 10:
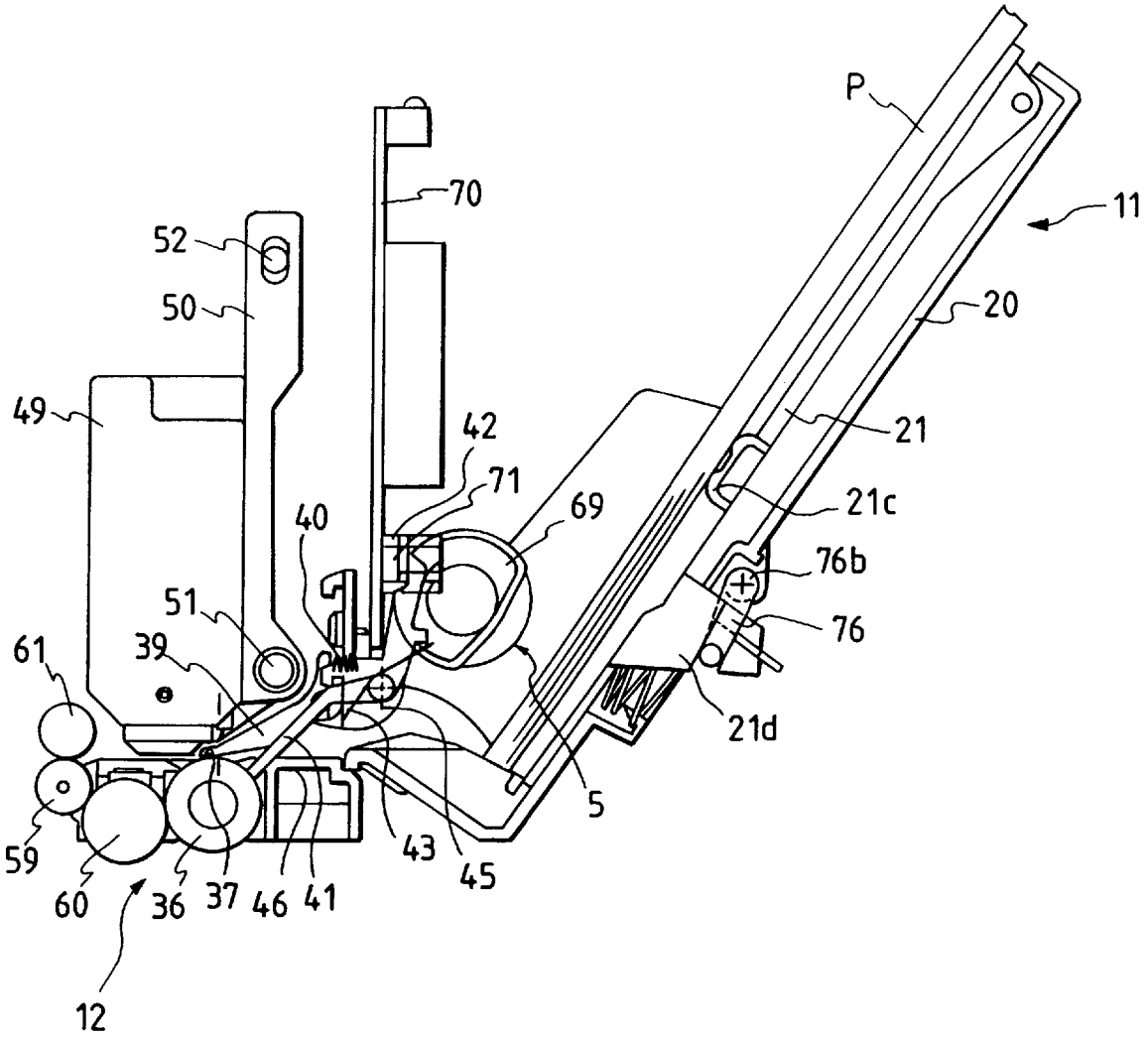
FIG. 10 is a side view showing the sheet feeding portion and a recording portion.

As shown in FIG. 10, the sheet convey portion 12 includes the convey roller 36, a pinch roller 37, a pinch roller guide 39, a pinch roller spring 40, a PE sensor lever 41, a PE sensor (sheet detecting means) 42, a PE sensor spring 43, an upper guide 45 and a platen 46.

The recording sheet P sent from the sheet feeding portion 11 to the sheet convey portion 12 is guided by the platen 46, pinch roller guide 39 and upper guide 45 and is sent to a pair of rollers comprised of the convey roller 36 and the pinch roller 37. The PE sensor lever 41 is disposed in front of (at an upstream side of) the pair of rollers 36, 37. When a leading end of the recording sheet P is detected by the PE sensor lever 41, a printing position on the recording sheet P is determined by the PE sensor 42. The pinch roller 37 is biased by the pinch roller spring 40 via the pinch roller guide 39 so that the pinch roller is urged against the convey roller 36, thereby providing a conveying force for the recording sheet P.

The recording sheet P sent to the pair of rollers 36, 37 is advanced on the platen 46 by the pair of rollers 36, 37 rotated by an LF motor 47 (FIG. 1) which will be described later; meanwhile, predetermined image information is recorded on the recording sheet by a recording head 49.

In FIG. 1, the recording head 49 is integrally formed with an ink tank to form an easy replaceable ink jet recording head. The recording head 49 has electrical/thermal converters so that ink is discharged from a discharge port by utilizing pressure change caused by growth and contraction of a bubble generated by film-boiling caused by applied thermal energy, thereby effecting recording.

Figure 2:
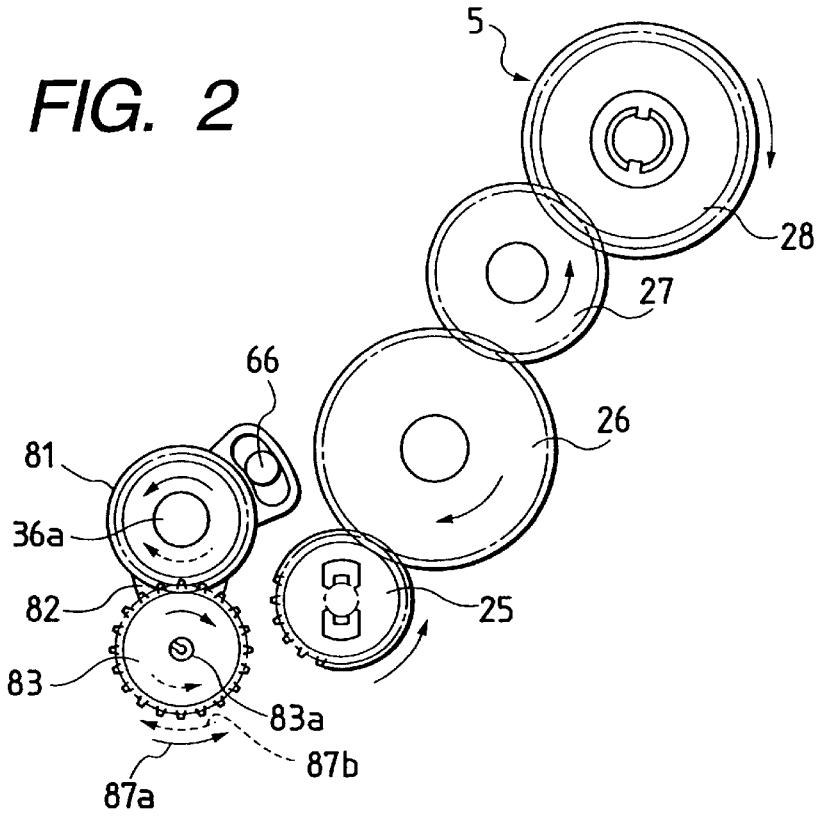
FIG. 2 is a view showing a gear train between a switching output gear and a sheet feed roller.
Figure 3:
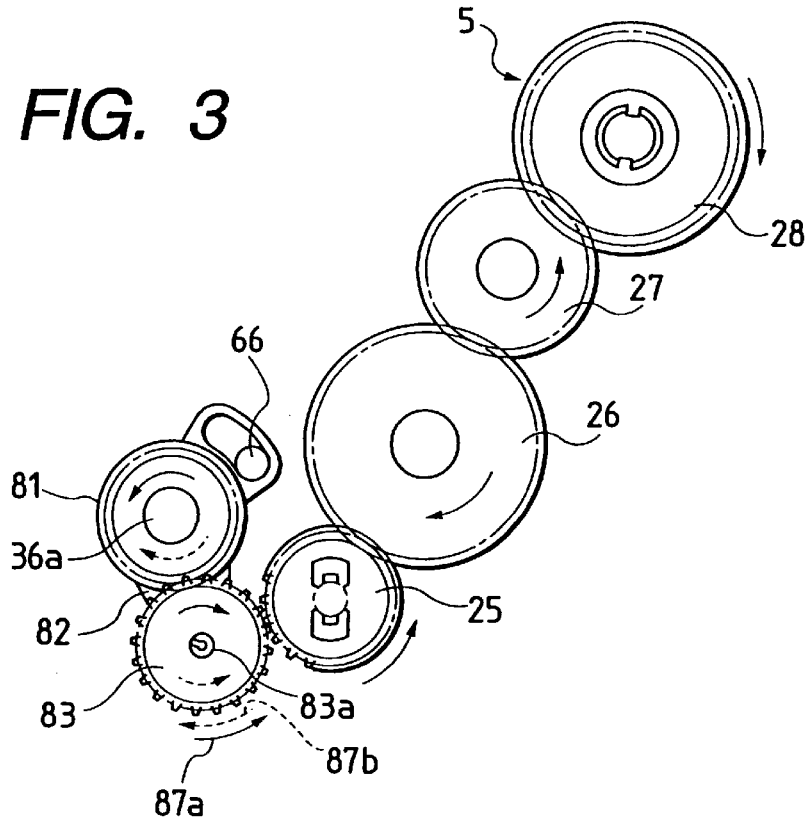
FIG. 3 is a view showing a gear train between a switching output gear and a sheet feed roller.

In FIGS. 1 to 3, a switching output gear 81 is integrally formed with the convey roller 36 (FIG. 10) and is reversibly rotated by the LF motor (convey motor) 47. A switching arm 82 has a base portion rotatably mounted on a support shaft 36*a* integral with the convey roller 36. The switching arm 82 can be rocked in directions shown by the arrows 87*a*, 87*b*. A switching output gear 83 is rotatably mounted on a support shaft 83*a* protruded from a free end of the switching arm 82 and can be engaged with the input gear 25 by rotation of the switching arm 82 to transmit normal rotation of the convey roller 36 to the input gear 25 and the associated sheet feeding roller 5. A control apparatus 80 controls rotations of the LF motor 47 and the convey roller 36 in a manner which will be described later.

In FIG. 1, a carriage portion (recording portion) 15 includes a carriage 50 to which the recording head 49 is attached, a guide shaft 51 for guiding reciprocal scan of the carriage 50 in a direction perpendicular to a conveying direction of the recording sheet P, a guide 52 for holding a rear end of the carriage 50 to maintain a predetermined gap between the recording head 49 and the sheet, a timing belt 55 for transmitting drive of a carriage motor 53 to the carriage 50, an idle pulley 56 for applying tension to the timing belt 55, and a flexible cable 57 for transmitting a head drive signal from an electric substrate 70 (FIG. 10) to the recording head 49. The recording head 49 is scanned together with the carriage 50, so that the image is formed on the recording sheet P conveyed on the platen 46.

In FIG. 1, a sheet discharge portion 13 includes sheet discharge rollers 59, transmission rollers 60 for transmitting the driving force of the convey roller 36 to the sheet discharge rollers 59, spurs 61 for aiding sheet discharging, and a sheet discharge tray 62.

The recording sheet P is discharged onto the sheet discharge tray 62 by the sheet discharge rollers 59 and the spurs 61 without distorting the image on the recording sheet P.

In FIG. 1, a cleaning portion 16 includes a pump 63 for cleaning the recording head 49, a cap 65 for preventing drying of the recording head 49, and a drive switching lever 66 for transmitting the driving force of the convey roller 36 to the sheet feeding portion 11 or the pump 63.

In FIG. 2, when the sheet is fed, the drive switching lever 66 is located at a position shown (except for cleaning) so that, since the switching output gear 83 to be rotated around the convey roller 36 is fixed or secured at a predetermined position, the driving force of the convey roller 36 is not transmitted to the pump 63 and the sheet feeding portion 11.

By shifting the carriage 50, the drive switching lever 66 is shifted in a direction shown by the arrow A, with the result that the switching output gear 83 is shifted by the normal or reverse rotation of the convey roller 36. In a condition that the carriage 50 is secured at the position in the direction A, when the convey roller 36 is rotated normally, the driving force of the LF motor 47 is transmitted to the sheet feeding portion 11; whereas, when the convey roller 36 is rotated reversely, the driving force of the LF motor 47 is transmitted to the pump 63.

Further, as the LF motor 47 for driving the convey roller 36 and the carriage motor 53 for driving the carriage 50, stepping motors rotated by predetermined angles in response to signals sent from drivers (not shown) are used.

Figure 4:
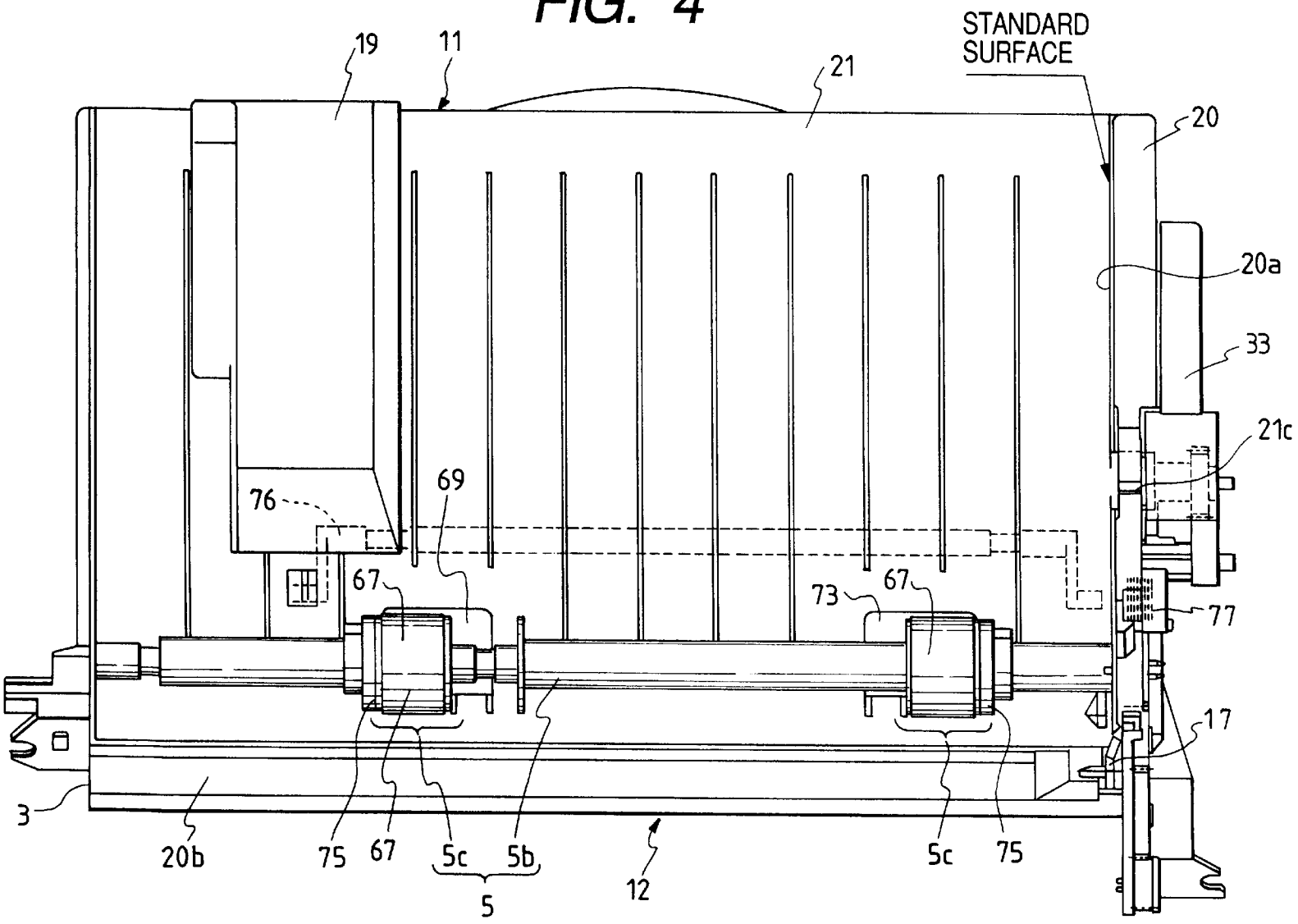
FIG. 4 is a plan view of a sheet feeding portion.

In FIGS. 4 and 10, the sheet feeding roller 5 is provided with a sensor plate 69 having a diameter smaller than a diameter of a sheet feeding rubber 67 attached to the sheet feeding roller 5. The sensor plate 69 has a cut-out portion so that, only when the sheet feeding roller 5 and the release cam 31 are located at their initial positions (FIGS. 6 and 7) where the pressure plate 21 is spaced apart from the sheet feeding roller 5, light from a roller sensor (position detecting means) 71 comprised of a photointerrupter directly attached to the electric substrate 70 is not interrupted. By detecting the position of the sensor plate 69, an angular position of the sheet feeding roller 5 and an angular position of the release cam 31 operated in synchronous with the sheet feeding roller 5 with the same phase can be detected, thereby providing a control timing of the recording sheet P in a sheet feeding sequence.

Next, main parts of the sheet feeding portion 11 will be described.

Various parts of the sheet feeding portion 11 are attached to the base 20 to form a unit. The sheet feeding portion 11 serves to feed the recording sheet by utilizing one lateral edge of the recording sheet P as a reference. A reference surface for receiving and positioning the recording sheet P is constituted by an inner wall 20*a* of a right side plate of the base 20.

As shown in FIG. 7, the base 20 has a particular shape so that the pressure plate 21 can be shifted to a retard position spaced apart from the sheet feeding roller 5. Further, as shown in FIG. 4, the base 20 is provided with recessed portions 20*c* (FIG. 7) for positioning the pressure plate springs 72 at positions substantially opposed to roller portions 5*c* of the sheet feeding roller 5.

As shown in FIG. 7, the pressure plate 21 is rotatably attached to the base 20 via pressure plate shafts 21*b* provided on both upper end portions of the pressure plate 21. In FIG. 4, separation pads 73 made of material having relatively high frictional coefficient such as synthetic leather are adhered to the pressure plate 21 at positions opposed to the roller portions 5*c* of the sheet feeding roller 5, so that, when the number of the recording sheets on the pressure plate becomes few, double-feeding is prevented. Further, the movable side guide 19 slidable in a left-and right direction is attached onto the pressure plate 21, so that, even when different size recording sheets P are used, one lateral edges of the sheets can be aligned by utilizing the reference surface 20*a* as the reference.

In FIG. 4, the sheet feeding roller 5 is rotatably supported by the base 20 at its both ends. The sheet feeding roller 5 is a integrally molded plastic part including a shaft portion 5*b* and the roller portions 5*c*, and the sheet feeding rubbers 67 for conveying the recording sheet P are provided on outer peripheral surfaces of the roller portions 5*c*. Each roller portion 5*c* has a D-cut (semi-circular) shape. Further, rollers 75 each having a radius smaller than a radius of the sheet feeding rubber 67 by about 0.5 mm to about 3 mm are provided on both sides of the roller portion 5*c*, so that contamination of the image or positional deviation of the sheet feeding roller 5 is prevented by not contacting the recording sheet P with the roller rubbers 67 of the sheet feeding roller 5 other than the sheet feeding.

Further, there are two roller portions 5*c* which are spaced apart from the reference surface by about 40 mm and about 170 mm, respectively. Accordingly, a recording sheet having A4 size is conveyed by the two roller portions 5*c*, and a post card is conveyed by only the single roller portion 5*c* near the reference surface 20*a*.

In FIG. 1, when the drive switching lever 66 of the cleaning portion 16 is shifted in the direction of the arrow A by the carriage 50 to rotate the convey roller 36 normally, in FIG. 3, the switching output gear 83 is shifted toward the direction 87*a*, with the result that the gear is engaged by the input gear 25, thereby transmitting the driving force of the LF motor 47 (FIG. 1) to the sheet feeding portion 11. In this case, since the switching output gear 83 is rocked toward the direction engaging with the input gear 25 to engage by the latter, so long as these gears once meshed with each other, even when the carriage 50 is shifted to a direction opposite to the direction A, the engagement between the gears is maintained to continue the transmission of the driving force.

The input gear 25 transmits the driving force to a sheet feeding roller gear 28 coupled to the sheet feeding roller 5 through idle gears 26, 27. The sheet feeding roller 5 is rotated by the sheet feeding roller gear 28 to convey the recording sheet P.

Figure 5:
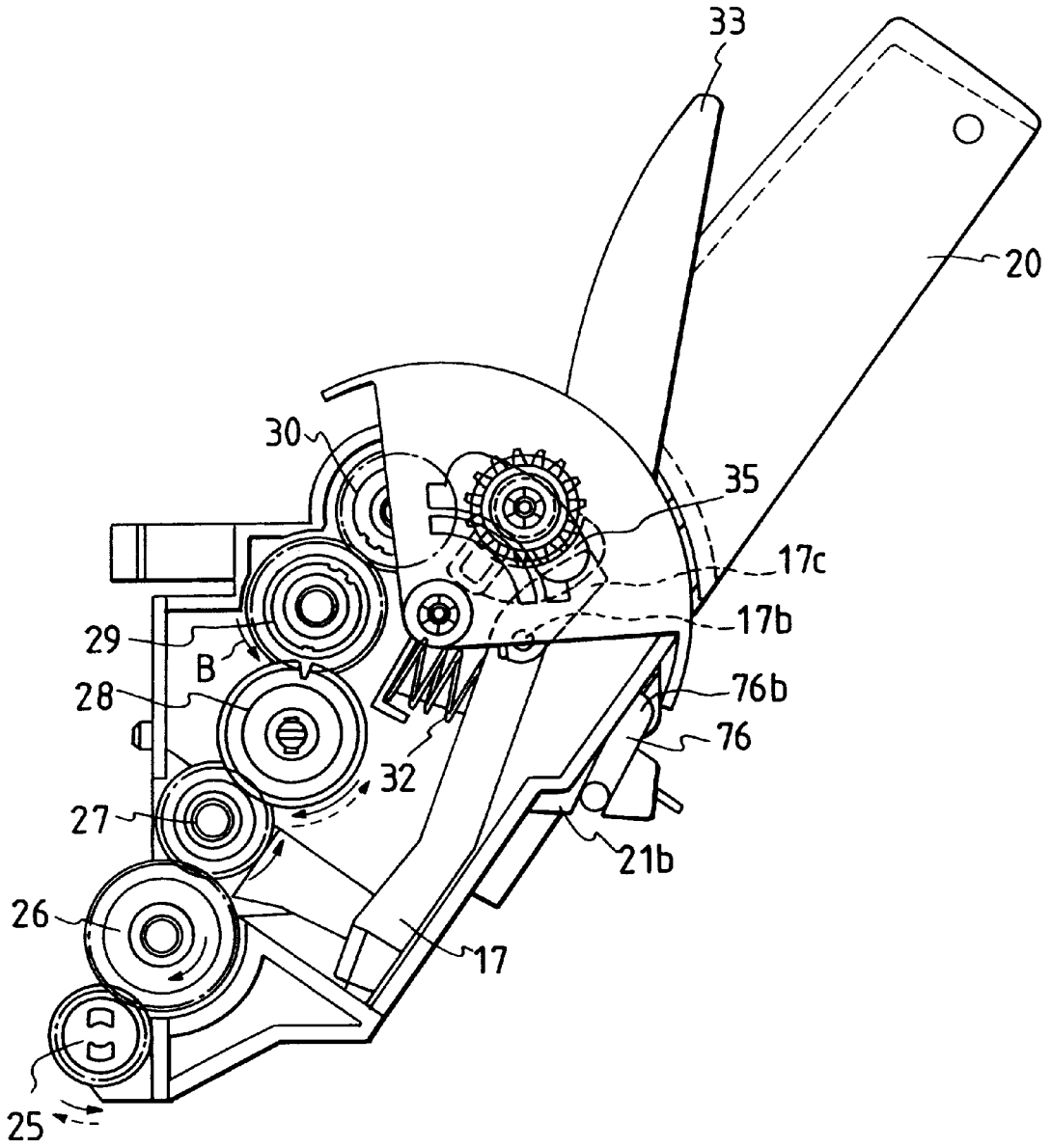
FIG. 5 is a side view of FIG. 4.

Further, the sheet feeding roller gear 28 transmits the driving force to the release cam 31 through a clutch gear 29 and an idler gear 30 shown in FIGS. 5 and 6. In this case, the sheet feeding roller 5 and the release cam 31 are designed and arranged so that phases thereof are aligned with each other for each revolution. That is to say, as shown in FIG. 7, in the condition that the pressure plate 21 is released from the release cam 31, as shown in FIG. 8, the sheet feeding roller 5 is designed and arranged so that the semi-circular portions are opposed to the pressure plate 21.

The release cam 31 is so shaped that it releases the pressure plate 21 only between the angle of about 120 degrees of semi-circular portions of the sheet feeding roller 5 and that it contacts the recording sheet P or the pressure plate 21 with an urging force of about 200 g to about 500 g without fail when portion of the sheet feeding roller 5 other than the semi-circular portions is opposed to the pressure plate 21. Further, the release cam 31 releases the pressure plate 21 by depressing a depressed portion 21*c* of the pressure plate 21 protruded from a hole formed in the right side plate of the base 20.

In this case, the pressure plate cam 76 attached to the base 20 is depressed by a cam 21*d* near the depressed portion 21*c* of the pressure plate 21, with the result that the pressure plate cam 76 is rotated around a center shaft 76*b*. And, in FIG. 4, a cam (not shown) outside of the left roller portion 5*c* is lowered by the pressure plate cam 76. As a result, even when the depressed portion 21*c* of the pressure plate 21 is depressed, the pressure plate 21 is not inclined with respect to the base 20, so that the pressure plate is released substantially.

The clutch gear 29 is provided at its interior with a clutch spring 77 (FIG. 4) so that the clutch spring 77 is tightened in the direction B in FIG. 5, thereby preventing reverse rotation. Thus, when the switching from the sheet feeding portion 11 to the sheet convey portion 12 is effected by the reverse rotation of the LF motor 47 or when the jammed sheet is removed or pulled by the operator, the sheet feeding roller 5 is not subjected to reverse rotation.

In FIGS. 4 and 5, the separation claw 17 can be rotate around a center shaft 17*b* and is biased by the claw spring 32 against the recording sheet P or the pressure plate 21 with an elastic force of about 20 g to about 100 g. The separation claw 17 serves to separate recording sheets P comprised of normal sheets and is positioned near the reference surface 20*a* as shown in FIG. 4 to cover a corner of the recording sheet P in a triangular fashion. Since the recording sheets P are subjected to resistance from the triangular claw, the sheets can be separated one by one. Further, separation of thick sheets other than normal sheet is effected by abutting the sheets against a lower guide portion 20*b* (FIG. 7) of the base 20 (without engaging the separation claw 17 with the sheets) to utilize frictional resistance of the lower guide portion 20*b*.

The releasing lever 33 and the releasing cam 35 (FIG. 5) are provided in coaxial with the release cam 31. The releasing lever 33 and the releasing cam 35 are not synchronous with the release cam 31 but are operated independently and aid to set the recording sheets P by the operator. The releasing lever 33 and the releasing cam 35 are interconnected through a gear.

The releasing lever 33 assumes (1) a feed position, (2) a thick sheet set position and (3) a normal sheet set position. An angle between these positions is selected to about 20 degrees to about 50 degrees. A ratio between the gears are set so that the releasing cam 35 is rotated by about 90 degrees in correspondence to three positions of the releasing lever 33.

In the feed position (1), the releasing cam 35 does not act on the depressed portion 21*c* of the pressure plate 21 and a depressed portion 17*c* of the separation claw 17. This position is selected during normal sheet feeding.

In the thick sheet set position (2), since the releasing cam 35 depresses only the depressed portion 21*c* of the pressure plate 21, the separation claw 17 is lowered to follow the pressure plate 21, with the result that the thick sheets can be set without engaging by the separation claw 17.

In the normal sheet set position (3), since the releasing cam 35 depresses both the depressed portion 21*c* of the pressure plate 21 and the depressed portion 17*c* of the separation claw 17, the separation claw 17 is lifted with respect to the pressure plate 21, with the result that the normal sheets can be set with engaging by the separation claw 17.

Incidentally, the above-mentioned group of gears, separation claw 17, releasing lever 33 and releasing cam 35 are provided on a shaft provided on the right side plate of the base 20 and are rotated around the shaft.

Next, function and control of the sheet feeding portion 11 in the sheet feeding will be fully explained.

Figure 11:
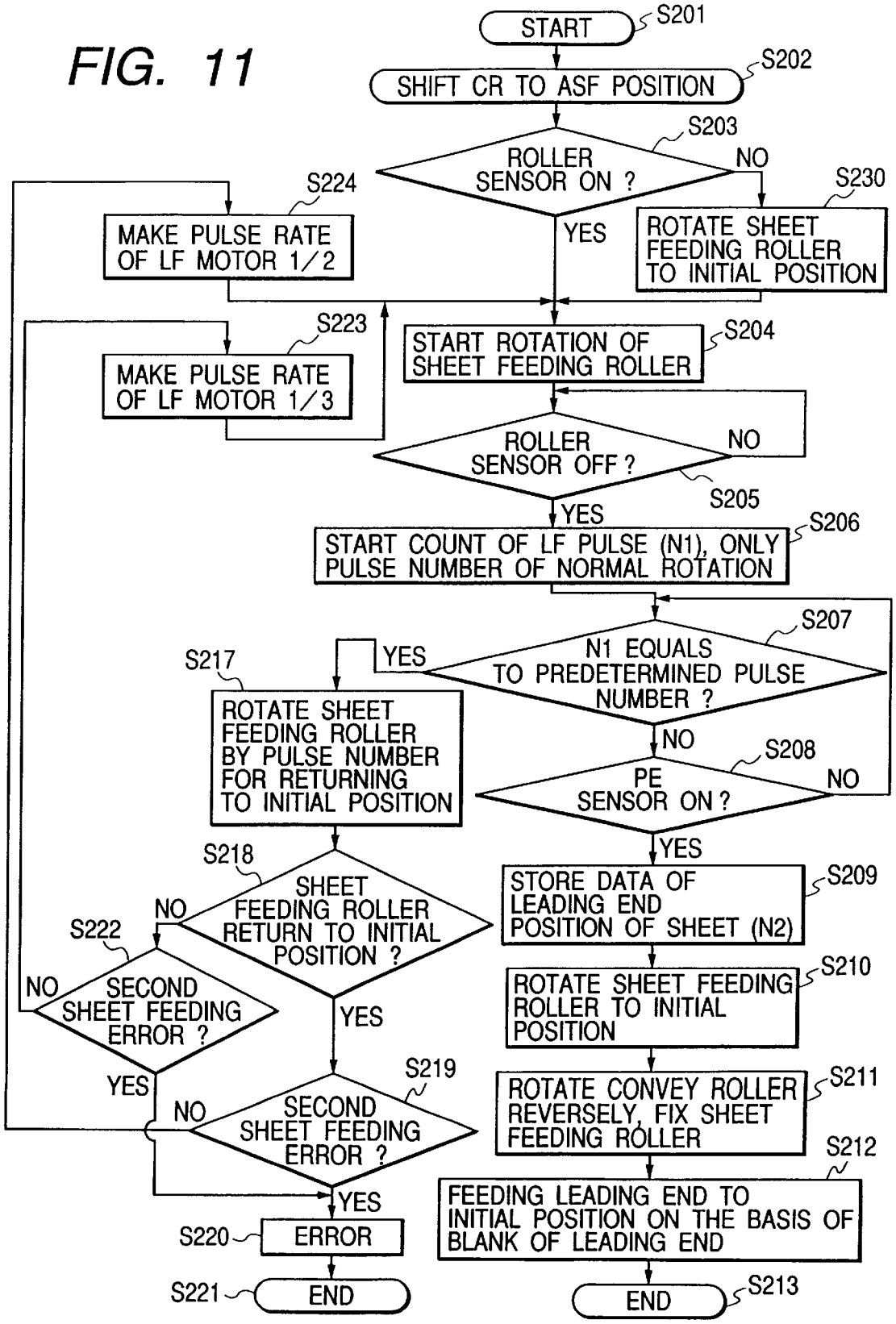
FIG. 11 is a flow chart for explaining a sheet feeding operation.

FIG. 11 is a flow chart showing entire control. FIGS. 9A to 9C are views showing the sheet feeding operation. Although such control can be divided into control effected when the sheet feeding roller 5 is in the predetermined initial position and control effected if the sheet feeding roller is not in the predetermined initial position (trouble condition), in the illustrated embodiment, only the control effected when the sheet feeding roller 5 is in the predetermined initial position will be described.

In response to a sheet feeding start signal in FIG. 11 (section 201; hereinafter, the "section" is referred to as "S"), first of all, the carriage (CR) 50 is shifted (S202) and the drive switching lever 66 is shifted so that the driving force of the convey roller 36 can be transmitted to the sheet feeding portion (ASF position).

Then, the rotational position of the sheet feeding roller 5 is detected by the roller sensor 71 (S203). If the sheet feeding roller 5 is in the initial position, the program goes to S204; whereas, if the sheet feeding roller 5 is not in the initial position, initialization of the sheet feeding roller 5 is effected (S230). When the sheet feeding roller 5 is in the initial position, the sheet feeding roller 5 is rotated (S204) and the edge of the sensor plate 69 (change from dark to bright of the sensor) is detected (S205). By counting the number (N1) of drive pulses of the LF motor 47 after the detection, the angular position of the sheet feeding roller 5 can be controlled correctly, thereby effecting high accurate control.

When the sheet feeding roller 5 is rotated by about 60 degrees to bring cylindrical portions of the sheet feeding rubbers 67 to a position opposed to the recording sheet P, the release cam 31 synchronous with the sheet feeding roller 5 releases the depression of the pressure plate 21. As a result, since the recording sheet P is urged against the sheet feeding rubbers 67 by the biasing forces of the pressure plate springs 72, the conveying force for the recording sheet P is generated. After the depression of the pressure plate 21 is released, the carriage 50 can be retarded, so that the initializing operation (ink pre-discharge, wiping and the like) of the recording head 49 can freely be performed during the sheet feeding.

The leading end of the recording sheet P being conveyed is detected by the PE sensor 41 (S207, S208). Even after the control apparatus 80 sends the pulses sufficient to rotate the sheet feeding roller 5 by the predetermined amount (to send the sheet up to the PE sensor 41) to the LF motor 47, if the leading end of the recording sheet P is not by the PE sensor 41, the following cases will be considered:

(1) a case where the LF motor causes out-of-phase as a result that excessive load acts on the sheet feeding roller 5;

(2) a case where the engagement between the input gear 25 and the switching output gear 83 for transmitting the driving force while rocking is released during the transmission of the driving force;

(3) a case where the sheet feeding roller 5 is slipped by an amount more than a predetermined amount; and (4) a case where there is no recording sheet P on the pressure plate 21.

First of all, if the sheet feeding error occurs due to the reasons (1) and (2), even when the LF motor 47 is rotated by the number of pulses required for returning the sheet feeding roller 5 to the initial position (S217), the fact that the sheet feeding roller 5 is not in the initial position is detected by the roller sensor 71 (S218). If this is a first error (S222: NO), the pulse rate of the LF motor 47 is reduced to ⅓ by the control apparatus 80 (S223), and the carriage 50 is shifted to the direction A to positively engage the switching output gear 83 with the input gear 25, thereby operating the sheet feeding roller 5 again. During the operation of the sheet feeding roller 5 this time, the carriage 50 is maintained in the shifted position in the direction A and is not shifted, thereby stopping the carriage at the switching position.

Further, for the reasons (3) and (4), when the LF motor 47 is rotated by the number of pulses required for returning the sheet feeding roller 5 to the initial position (S217), since the fact that the sheet feeding roller 5 is returned to the initial position is ascertained (S218), if this time error is not second sheet feeding error (i.e., is the first sheet feeding error), the sheet feeding roller 5 is rotated again by one revolution (S219). In this case, the pulse rate of the LF motor 47 is set by the control apparatus to half of the first rotation.

For the reason (4), since the PE sensor is not turned ON again, the operation is stopped and error display is effected (S220) and the operation is ended (S221).

If the PE sensor is turned ON till the sheet feeding roller 5 is rotated by the predetermined rotational amount, data (N2) of a leading end position of the sheet is determined from the angular position of the sheet feeding roller 5 upon ON of the PE sensor 41 and is stored (S209).

Then, by continuously rotating the sheet feeding roller 5 up to the initial position (S210), the recording sheet P is conveyed ahead of the pair of separation rollers (convey roller 36 and pinch roller 37), and the feeding of the leading end to the initial position for setting blank of the leading end is effected.

In the illustrated embodiment, while the sheet feeding roller 5 is being rotated by one revolution, after the PE sensor 41 is turned ON, the recording sheet is conveyed to the pair of separation rollers 36, 37 by a distance of a $\alpha$ mm and is further conveyed ahead of the pair of separation rollers by a distance of $\beta$ mm, and then, the sheet feeding roller 5 is stopped. And, the convey roller 36 is rotated reversely (S211) to disengage the switching output gear 83 from the input gear 25, thereby rocking the switching output gear to the position shown in FIG. 2. Thereafter, the convey roller 36 is rotated normally by an amount based upon the blank of the leading end (S212). The amounts of the reverse to normal rotations in this case can be divided into the following cases to minimize the reverse rotation amount, when it is assumed that a minimum reverse rotation amount required for switching from the sheet feeding position to the conveying position is $\gamma$ mm, a normal rotation amount required for removing backlash is a $\sigma$ mm, an amount of the blank of the leading end (distance between the leading end of the sheet and a recording start position) is $\delta$ mm and a distance between the pair of separation rollers and the writing start position of the recording head 49 is $\epsilon$ mm:

(1) when $\epsilon\sigma+\gamma<\beta-\delta$ (when the amount of the blank is small):

$(\beta-\delta)-(\epsilon+\sigma)$ reverse rotation $\rightarrow\sigma$ a normal rotation ($\rightarrow$a start recording);

(2) when $\epsilon-\sigma+\gamma>\beta-\delta$ (when the amount of the blank is great):

$\gamma$ reverse rotation $\rightarrow\epsilon-(\beta-\gamma-\delta)$ normal rotation ($\rightarrow$a start recording); and (3) when $\gamma>\beta$:

sheet re-feeding (retry).

When the normal rotation is completed in this way, the proper amount of the feeding of the leading end to the initial position is set, thereby permitting the initiation of the recording.

As mentioned above, when the predetermined number of pulses is given, if the initialization of the sheet feeding roller 5 is not effected, by reducing the pulse rate of the motor in the retry, the possibility of the sheet feeding is considerably improved even in the excessive load condition.

Further, when the predetermined number of pulses is given, if the initialization of the sheet feeding roller 5 is effected without reaching of the sheet, by decreasing the sheet feeding and conveying speed (pulse rate of the motor) in the retry, the reliability of sheet conveyance regarding slip of the sheet feeding roller, poor sheet feeding due to looseness and bad quality sheet can be enhanced.

Incidentally, in the illustrated embodiment, while an example that the rotational speed and rotation time of the sheet feeding roller 5 are controlled by using the pulse motor was explained, the rotational speed and rotation time of the sheet feeding roller may be controlled by using a DC motor through an encoder and a timer.

What is claimed is:

1. A sheet feeding apparatus comprising:

a sheet supporting means for supporting a sheet;

a sheet feeding means for feeding the sheet supported by said sheet supporting means;

a driving means for driving said sheet feeding means;

a sheet detecting means for detecting the sheet fed by said sheet feeding means; and a drive control means for controlling said driving means in such a manner that, even when said driving means is operated at a predetermined speed for a predetermined time period, if the sheet is not detected by said sheet detecting means, said driving means is operated at a speed slower than the predetermined speed.

2. A sheet feeding apparatus according to claim 1, further comprising a position detecting means for detecting the fact that said sheet feeding means is in its initial position.

3. A sheet feeding apparatus according to claim 2, wherein said drive control means causes said sheet feeding means to return it to said initial position if the sheet is not detected by said sheet detecting means, whereby said position detecting means detects whether said sheet feeding means is in said initial position, and changes an operating speed of said sheet feeding means effected by said driving means between a case where said sheet feeding means is in said initial position and a case where said sheet feeding means is not in said initial position.

4. A sheet feeding apparatus according to claim 3, wherein said drive control means reduces the operating speed of said sheet feeding means in the case where the fact that said sheet feeding means is not in said initial position is detected by said position detecting means lower than the operating speed of said sheet feeding means in the case where the fact that said sheet feeding means is in said initial position is detected by said position detecting means.

5. A sheet feeding apparatus according to claim 4, wherein the operating speed of said sheet feeding means in the case where the fact that said sheet feeding means is in said initial position is detected by said position detecting means is set to ½ of said predetermined speed, and the operating speed of said sheet feeding means in the case where the fact that said sheet feeding means is not in said initial position is detected by said position detecting means is set to ⅓ of said predetermined speed.

6. A sheet feeding apparatus according to claim 1, wherein said driving means comprises a stepping motor, and further wherein, when the number of pulses given from said drive control means to said stepping motor reaches a predetermined pulse number, if the sheet is not detected by said sheet detecting means, said drive control means reduce a pulse rate to reduce the operating speed of said sheet feeding means.

7. A sheet feeding apparatus according to claim 1, wherein said sheet feeding means comprises a feed roller, and said feed roller is rotated at a predetermined rotational speed for a predetermined time period by a driving force from said driving means controlled by said drive control means.

8. A sheet feeding apparatus according to claim 2, wherein said sheet feeding means comprises a feed roller, and said position detecting means detects a rotational angle of said feed roller.

9. A sheet feeding apparatus according to claim 1, wherein said drive control means causes said sheet feeding means to rotate at a speed slower than said predetermined speed, and further wherein, if the sheet is not detected by said sheet detecting means even after a predetermined time period is elapse, error display is effected.

10. A sheet feeding apparatus according to claim 3, wherein said driving means comprises a stepping motor, and further wherein, if the sheet is not detected by said sheet detecting means, said control means gives the number of pulses required for returning said sheet feeding means to the initial position to said stepping motor, thereby causing said position detecting means to detect the sheet.

11. A recording apparatus comprising:

a sheet supporting means for supporting a sheet;

a sheet feeding means for feeding the sheet supported by said sheet supporting means;

a driving means for driving said sheet feeding means;

a sheet detecting means for detecting the sheet fed by said sheet feeding means;

a drive control means for controlling said driving means in such a manner that, even when said driving means is operated at a predetermined speed for a predetermined time period, if the sheet is not detected by said sheet detecting means, said driving means is operated at a speed slower than the predetermined speed; and a recording means for effecting recording on the sheet fed out by said sheet feeding means.

* * * * *

UNITED STATES PATENT AND TRADEMARK OFFICE

CERTIFICATE OF CORRECTION

PATENT NO. : 6,135,439

DATED : October 24, 2000

INVENTOR(S): YASUHIKO IKEDA

It is certified that error appears in the above-identified patent and that said Letters Patent is hereby corrected as shown below:

COLUMN 6:
Line 29, "rotate" should read --rotated--.

COLUMN 8:
Line 66, "$\varepsilon\sigma+\gamma<\beta-\delta$" should read --$\epsilon\sigma+\gamma<\beta-\delta$--.

COLUMN 9:
Line 1, "(→a" should read --(→--; and
Line 5, "(→a" should read --(→--.

COLUMN 10:
Line 20, "reduce" should read --reduces--.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*